United States Patent [19]

Braxmeier

[11] Patent Number: 4,796,419

[45] Date of Patent: Jan. 10, 1989

[54] BEARING SUPPORT FOR A TWISTING OR SPINNING MACHINE

[75] Inventor: Hans Braxmeier, Süssen, Fed. Rep. of Germany

[73] Assignee: Novibra GmbH, Fed. Rep. of Germany

[21] Appl. No.: 7,200

[22] Filed: Jan. 27, 1987

[30] Foreign Application Priority Data

Feb. 8, 1986 [DE] Fed. Rep. of Germany ..... 3603999

[51] Int. Cl.[4] ..... D01H 7/20; D01H 7/12; F16C 33/66

[52] U.S. Cl. ..... 57/134; 57/130; 57/135; 384/239; 384/241; 384/397; 384/398; 384/474

[58] Field of Search ..... 57/129–135; 384/227, 239–241, 286, 397, 398, 473, 474, 494

[56] References Cited

U.S. PATENT DOCUMENTS

| | | | |
|---|---|---|---|
| 1,924,282 | 8/1933 | Jenny | 384/473 |
| 2,499,075 | 2/1950 | Robinson et al. | 384/241 |
| 2,647,806 | 8/1953 | Simmons | 384/241 |
| 2,664,696 | 1/1954 | Quast | 57/133 |
| 2,780,049 | 2/1957 | Findlow | 57/133 |
| 2,981,544 | 4/1961 | Better | 384/494 X |
| 3,224,296 | 12/1965 | Civelli | 384/398 X |
| 3,911,659 | 10/1975 | Mandl | 57/133 X |
| 3,958,846 | 5/1976 | Donner | 57/133 X |
| 4,021,086 | 5/1977 | Rajsigl | 384/473 |
| 4,022,008 | 5/1977 | Pimiskern et al. | 384/241 X |
| 4,116,505 | 9/1978 | Stahlecker | 384/241 X |
| 4,340,262 | 7/1982 | Rugh et al. | 384/473 |
| 4,448,016 | 5/1984 | Thalman | 57/133 |

*Primary Examiner*—John Petrakes
*Attorney, Agent, or Firm*—Barnes & Thornburg

[57] ABSTRACT

A bearing assembly for a spinning or twisting spindle shaft is provided which includes at least one support bearing device for supporting a shaft. A lubricant feeding and discharging duct member is provided for feeding and discharging lubricant to and from the support bearing device. The lubricant feeding and discharging duct member includes an outlet discharging member for discharging lubricant out of a bearing housing.

12 Claims, 3 Drawing Sheets

BEARING SUPPORT FOR A TWISTING OR SPINNING MACHINE

BACKGROUND AND SUMMARY OF THE INVENTION

The invention relates to a bearing for a spinning or twisting spindle, having a shaft disposed in a bearing housing by means of roller bearings. For the feeding of lubricating grease, the bearing housing is provided with separate grease-feeding ducts for each roller bearing, each having an inlet opening and leading to one roller bearing respectively.

In a known bearing of the initially mentioned type for use in a two-for-one twisting spindle, grease-guiding ducts are provided in the bearing housing of the spindle through which lubricating grease can be fed to each roller bearing in an apportioned way. However, the used lubricating grease is practically left to itself, and in the case of a relubrication, leaks out at the respective roller bearing in an uncontrolled way. There is a danger that this used lubricating grease may reach the area of a driving wharve or the area of yarn-guiding elements which may impair the drive and/or the twisting process.

An object of the invention is to make a bearing of the initially mentioned type in such a way that when the bearing is relubricated, the danger of contaminating parts that are essential for the operation is avoided.

This object is achieved by assigning to each roller bearing a grease removal duct for the discharge of the grease that leads to an outlet opening at the bearing housing.

By this development, it is ensured that the used lubricating grease comes out at a defined point where it can be removed easily. Thus, the danger that the used lubricating grease coming out during the relubrication reaches areas in which it can result in disturbances is avoided.

In an advantageous development of the invention, it is provided that the grease-feeding ducts and the grease discharge ducts are assigned to respective opposite end faces of the pertaining roller bearings. This ensures that the lubricating grease fed during the relubrication will force the used lubricating grease out of the area of the roller bearings so that the used lubricating grease can not come back into the area of the roller bearings.

In a further development of the invention, it is provided that the grease discharge ducts lead out into a joint outlet opening. This has the advantage that the used grease must be removed from only one single point.

In a further development of the invention, it is provided that the inlet openings and the at least one outlet opening are arranged adjacent to one another in the bearing housing. In this arrangement, the inlet and outlet openings may be arranged in a common area that may be selected in such a way that is easily accessible for the operating personnel.

In a further development of the invention, it is provided that a part of at least one grease discharge duct is housed between the shaft of the spindle and a spacing sleeve mutually supporting the bearings. As a result, it is possible to use already existing elements for the development of the grease discharge duct or ducts.

In a further development of the invention, it is provided that between the bearing housing and a spacing sleeve mutually supporting the bearings, a separating sleeve is arranged that on its interior surface and/or exterior surface, is provided with longitudinal grooves that are a component of the grease-feeding ducts or the grease discharge ducts. This separating sleeve, which is a simple component preferably made of plastic, permits a simple arrangement of the required ducts which are securely separated from one another.

In a further development of the invention, it is provided that at least one of the grease-feeding ducts has a section that extends around the outer raceway of the pertaining roller bearing in a spiral shape. This arrangement makes it possible to reverse the direction of the lubricating grease feeding process in the area of the roller bearing. The arrangement of the outer raceway of the bearing and/or its receiving surface are not impaired in this case.

Other objects, advantages and novel features of the present invention will become apparent from the following detailed description of the invention when considered in conjunction with the accompanying drawings.

Figure 1:
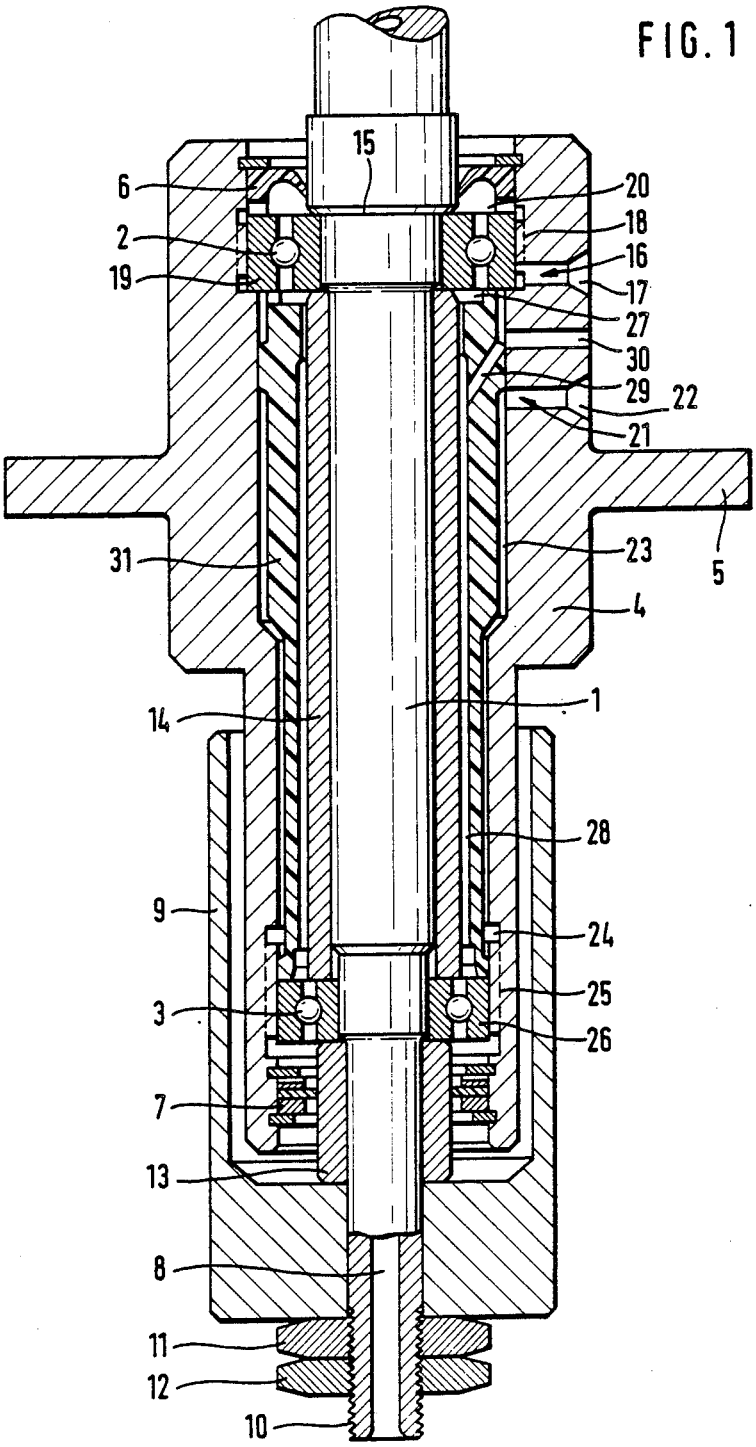
FIG. 1 is a longitudinal cross-sectional view of a bearing of a two-for-one twisting spindle.

The development of a bearing according to the invention in the following is described by means of a two-for-one spindle. Naturally, the invention may also be used in other types of spindles, particularly in hollow spindles, such as hollow spindles for turn-over spinning machines.

The only partially shown spindle contains a spindle shaft (1) that is disposed in a bearing housing (4) by two ball bearings (2) and (3). The essentially cylindrical bearing housing (4) is equipped with a radial flange (5) via which it can be fastened at a spindle rail, in a way that is not shown. The ball bearing (2) that is on top in the drawing is sealed off to the outside by a sealing raceway (6) inserted into the bearing housing (4). The ball bearing (3) that is at the bottom in the drawing is sealed off to the outside by sealing elements that are also inserted into the bearing housing (4).

The shaft (1) that is provided with a longitudinal bore (8) for the guiding-through of yarn that was spun or is to be cabled projects out of the bearing housing (4), in downward direction. On this area of the shaft (1), a driving wharve that has a pot-shaped design (9) is mounted with a press fit, and in a sleeve-shaped way encloses the lower part of the bearing housing (4). The end of the shaft (1) is equipped with an external thread (10) on to which a nut (11) and a check nut (12) are screwed that support the driving wharve (9) with respect to the inner raceway of the ball bearing (3) via a spacing sleeve (13). Between the inner rings of the ball bearings (2) and (3), another spacing sleeve(14) is provided. The inner raceway of the ball bearing (2) is supported at a shoulder (15) of the shaft (1).

A grease lubrication is provided for the ball bearings (2) and (3). In order to permit a perfect relubrication, in which the used lubricating grease is securely removed from the area of the ball bearings (2) and (3) and does not come out in an uncontrolled way, a special lubricating-grease guiding means is provided.

For the upper ball bearing (2), a grease-feeding duct (16) is provided that starts with an inlet opening (17) at the outside of the bearing housing (4), and that is aimed radially to the outer bearing raceway (19) of the ball bearing (2). The grease feeding duct (16) leads out into a raceway groove that via one or several spiral-shaped grooves (18), extends in axial direction along the outer raceway (19) of the bearing to its other end face. On this side, a space (20) is provided via which the fed lubricating grease reaches the ball bearing (2) and can penetrate into it. In this case, the used lubricating grease is pressed out of the ball bearing (2) at the other end face. A grease discharge duct (27) is provided for this used grease. The grease discharge duct (27) is connected with an outlet opening (30) that is located in the area of the inlet opening (17).

The lower ball bearing (3) has its own grease-feeding duct (21) that starts in the bearing housing (4) at an inlet opening (22) that is adjacent to the inlet opening (17) of the grease-feeding duct (16) and to the outlet opening (30). A separating sleeve (31) is arranged between the spacing sleeve (14) and the interior wall of the bearing housing (4). The separating sleeve (31) forms a duct section (23) for the grease-feeding duct (21) by means of a circumferential gap to the bearing housing (4) or by longitudinal grooves. With its first section, the grease-feeding duct (21) leads out into this section (23). In the area just above the bearing (3), a raceway groove (24) is worked into the bearing housing (4) to which a spiral-shaped section (25) connects. This spiral-shaped section is guided around the outer raceway (26) of the ball bearing (3), so that the fed lubricating grease reaches an area below the ball bearing (3) and is fed to the lower end face.

In the case of a relubrication, the used lubricating grease comes out on the opposite end face of the ball bearing (3), i.e., the top end face. With respect to section (25) and also with respect to section (23), this area is separated by the separating sleeve (31) so that a separation with respect to the grease-guiding duct (21, 23, 24, 25) is achieved. The interior side of the separating sleeve (31), that preferably is provided with longitudinal grooves, together with the outer side of the spacing sleeve (14) forms a grease discharge duct (28). The raceway gap between the separating sleeve (31) and the spacing sleeve (14) or the longitudinally extending longitudinal grooves extend up to the area of the outlet opening (30) worked into the bearing housing (4). In the area of this outlet opening (30), the separating sleeve (31) is connected with a connecting opening (29) between the grease discharge duct (28) and the outlet opening (30). Above this area, the cylindrical section of separating sleeve (31) is situated close to the exterior side of the spacing sleeve (14), so that a sealing is created that prevents the used grease discharged in the grease discharge duct (28) from reaching the area of the ball bearing (2).

The separating sleeve (31) is supported against the outer raceway (26) of the ball bearing (3) at its lower ends, and is supported against the outer raceway (19) of the ball bearing (2) by a collar at its upper end. The collar leaves a space that is used as the grease discharge duct (27) on the front side of the ball bearing (3) facing the separating sleeve (31). In the collar-type support of the separating sleeve (31), several breakthroughs distributed over the circumference are provided that are connected with a raceway space between the bearing housing (4) and the exterior side of the separating sleeve (31). This raceway space leads to the outlet opening (30) that is assigned to both grease discharge ducts (27), (28) jointly.

Figure 2:
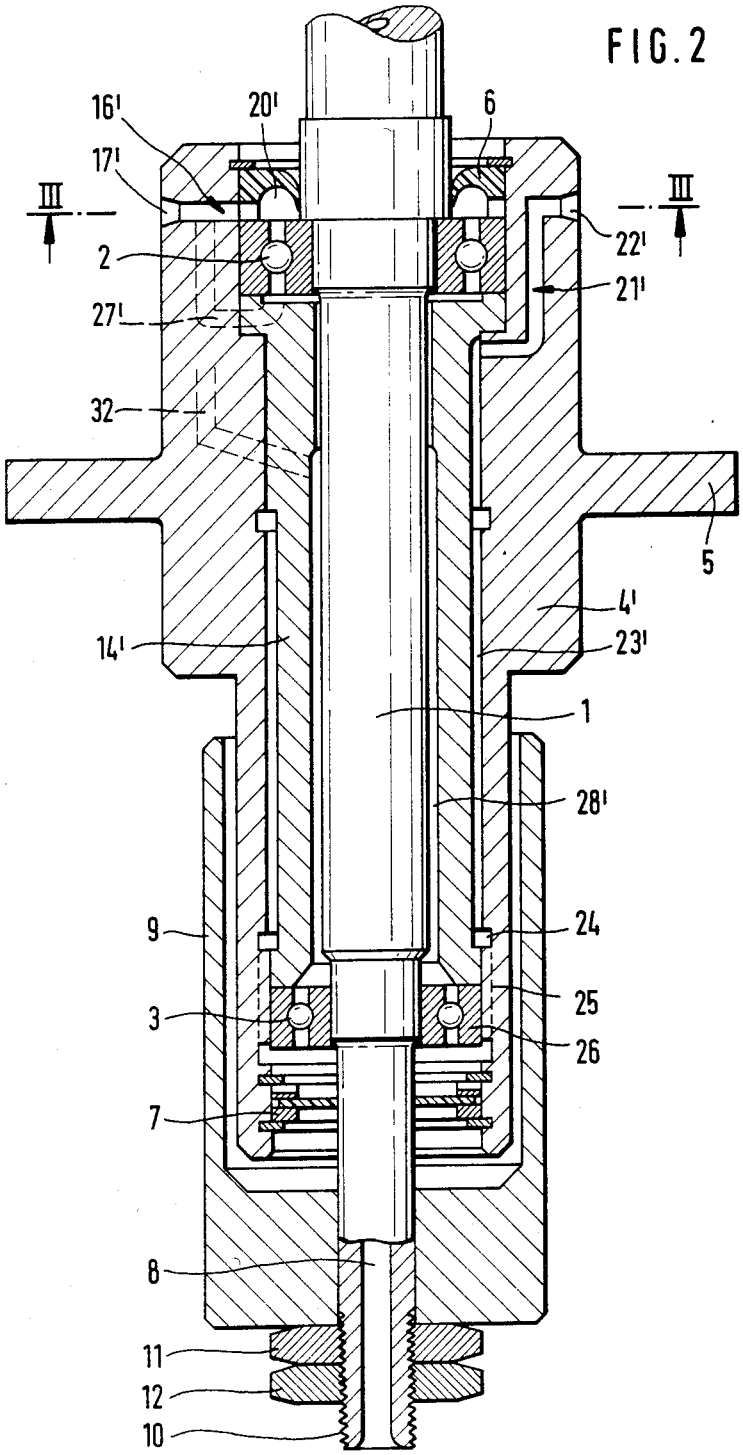
FIG. 2 is a longitudinal cross-sectional view of another embodiment of a two-for-one twisting spindle.

The embodiment according to FIG. 2 has a construction that is essentially similar to the embodiment according to FIG. 1 so that the same reference numbers are used to the extent that corresponding parts exist. Also in the case of this embodiment, the shaft (1) of a spindle is disposed in a bearing housing (4') by two ball bearings (2) and (3). The upper ball bearing (2) is sealed off to the outside by a sealing raceway (6). The sealing raceway is inserted into the bearing housing(4'). The lower ball bearing (3) is sealed off to the outside by sealing elements (7) that interact directly with the end of the shaft (1) projecting from the bearing housing(4'). These sealing elements (7) intersect directly with the shaft (1) in this embodiment, because the spacing sleeve (13) between the ball bearing (3) and the wharve (9) mounted on the lower end of the shaft (1), which is provided in FIG. 1, is left out of the embodiment as shown in FIG. 2.

A grease-guiding duct (16') is assigned to the upper roller bearing (2). This duct (16') starts with an inlet opening (17'), is radially worked into the bearing housing (4'), and leads into a space (20') on the side of the sealing raceway (6) in front of the end face of the ball bearing (2). The used lubricating grease comes out of the lower end face of the ball bearing (2) and is discharged via a grease discharge duct (27') and through an opening (33) on the outside which leads out at the bearing housing (4') (see FIG. 3). In this embodiment, the bearing housing is divided into the actual bearing housing (4') and a type of spacing raceway (14'), against which the two outer rings (19) and (26) of the ball bearings (2) an (3) support themselves. This division makes a simplified mounting of the ducts possible.

At the level of the inlet opening (17'), an additional inlet opening (22') is provided for a grease-feeding duct (21') that is intended for feeding lubricating grease to the lower ball bearing (3). The grease-feeding duct (21') is continued into the area of the lower ball bearing (3) via a raceway space formed by longitudinal grooves of the sleeve (14'). In this area, a surrounding raceway groove (24) is located, and a spiral-shaped section starts at this raceway groove (24). The spiral-shaped section extends on the outside around the outer raceway (26) of the ball bearing (3) so that the lubricating grease during the relubrication is fed to the lower end face of the ball bearing (3). The used lubricating grease coming out of the ball bearing (3) discharges at the opposite end face and arrives in a raceway space between the sleeve (14') and the shaft (1) that is used as the grease discharge duct (28'). An opening (32) branches off from this grease discharge duct (28'). This opening is connected with an outlet opening (34).

For reasons of representation in FIG. 2, the inlet openings (17', 22') and the outlet openings (32) and the outlet opening (33) which is part of the grease discharge duct (27') that is not shown, are shown as being arranged relatively far from one another.

Figure 3:
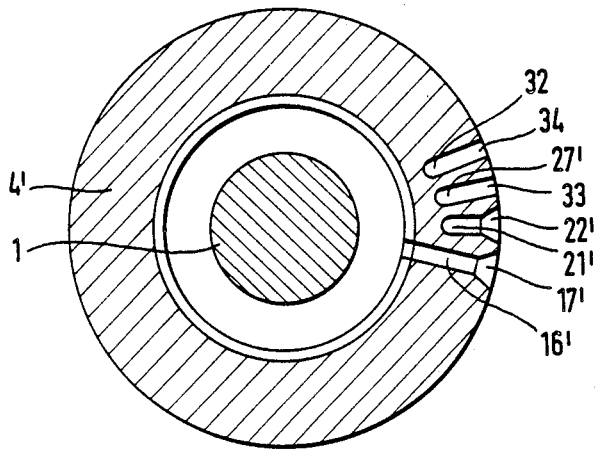
FIG. 3 is a cross-sectional view along the Line III—III of FIG. 2.

As shown in FIG. 3, these openings (17', 22', 33 and 34) are located closely next to one another in a radial plane extending essentially in the direction of the axis of rotation of the shaft (1), so that when it is installed correspondingly it is easily accessible to an operator.

In the embodiment according to FIG. 1 as well as in the case of the embodiment according to FIG. 2, it is provided that the inlet openings (17, 22) as well as (17') and (22') have a shape that differs from the shape of the outlet openings (30, 33, 34), so that a mixup cannot occur during relubrication. As shown in the figures, one possible example is to provide the inlet openings (17, 22) and (17', 22') with a conical recession that facilitates the insertion of a lubricating tool. Obviously, many different shapes can be provided.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Spinning or twisting spindle assembly having at least one spindle shaft comprising:

at least two supporting bearing means for supporting said shaft;

bearing housing means in which said supporting bearing means are disposed;

lubricant feeding and discharging duct means for feeding and discharging lubricant to and from said at least two supporting bearing means, said lubricant feeding and discharging duct means including at least one lubricant feeding duct for each of said at least two supporting bearing means and at least one lubricant discharging duct for each of said at least two supporting bearing means;

at least one outlet discharging means through which lubricant is discharged out of said bearing housing means; and at least one inlet feeding means for feeding lubricant into said bearing housing means, said at least one inlet feeding means being disposed adjacent said at least one outlet discharging means.

2. Bearing assembly as in claim 1, wherein said at least two supporting bearing means include a first end face oppositely facing from a second end face at each of said at least two supporting bearing means, said at least one lubricant feeding duct being assigned to said first end face and said at least one lubricant discharging duct being assigned to said second end face.

3. Bearing assembly as in claim 2 wherein said supporting bearing means includes an outer raceway between said first and second end faces, and wherein at least one of said lubricant feeding ducts includes a spiral-shaped section, said spiral-shaped section being disposed around said outer raceway of said bearing means.

4. Bearing assembly as in claim 1, wherein said lubricant discharging ducts feed into a common outlet discharging means.

5. Bearing assembly as in claim 1 wherein said inlet feeding means and outlet discharging means each include at least one mouth opening, said at least one mouth opening of said inlet feeding means being shaped differently from said at least one mouth opening of said outlet discharging means.

6. Bearing assembly as in claim 1, further including a spacing sleeve means for supporting each of said supporting bearing means, said spacing sleeve means being concentric to the shaft.

7. Bearing assembly as in claim 6, wherein the at least one lubricant discharging duct is disposed between the shaft and the spacing sleeve means.

8. Bearing assembly as in claim 6, further including:

a shaft housing means for housing the shaft and the spacing sleeve means; and a separating sleeve disposed between the shaft housing means and the spacing sleeve means, said separating sleeve including an interior surface and an exterior surface, at least one of said interior surface and said exterior surface including longitudinal groove, said longitudinal grooves being components of at least one of said at least one lubricant feeding duct and said at least one lubricant discharging duct.

9. Bearing assembly as in claim 1, wherein said lubricant feeding and discharging duct means include lubricant grease feeding and discharging ducts.

10. Spinning or twisting spindle housing assembly having at least one spindle draft and at least two supporting bearing means for supporting the at least one spinning or twisting spindle shaft comprising:

bearing housing means in which said supporting bearing means are disposed;

lubricant feeding and discharging duct means for feeding and discharging lubricant to and from said supporting bearing means disposed in said bearing housing means, said lubricant feeding and discharging duct means including at least one supporting bearing means and at least one lubricant discharging duct leading from each of said at least two supporting bearing means;

at least one outlet discharging means through which lubricant is discharged out of said bearing housing means; and at least one inlet feeding means for feeding lubricant into said bearing housing means, said at least one inlet feeding means being disposed adjacent said at least one outlet discharging means.

11. Bearing assembly as in claim 10 wherein said inlet feeding means and outlet discharging means each include at least one mouth opening, said at least one mouth opening of said inlet feeding means being shaped differently from said at least one mouth opening of said outlet discharging means.

12. Bearing assembly for a spinning or twisting spindle shaft comprising:

at least two supporting bearing means for supporting said shaft;

bearing housing means in which said supporting bearing means are disposed;

lubricant feeding and discharging duct means for feeding and discharging lubricant to and from said at least two supporting bearing means, said lubricant feeding and discharging duct means including at least one lubricant feeding duct for each of said at least two supporting bearing means and at least one lubricant discharging duct for each of said at least two supporting bearing means;

a spacing sleeve means for supporting each of said supporting bearing means, said spacing sleeve means being concentric to the shaft;

a shaft housing means for housing the shaft and the spacing sleeve means; and a separating sleeve disposed between the shaft housing means and the spacing sleeve means, said separating sleeve including an interior surface and an exterior surface, at least one of said interior surface and said exterior surface including longitudinal grooves, said longitudinal grooves being components of at least one of said at least one lubricant feeding duct and said at least one lubricant discharging duct.

* * * * *